US006109761A

United States Patent [19]

Smith et al.

[11] Patent Number: 6,109,761

[45] Date of Patent: Aug. 29, 2000

[54] BEAN BAG FLASHLIGHT

[76] Inventors: Carol Smith, 933 Tropico Ct., Sparks, Nev. 89436; Paul Berman, 1650 Tenth St., Santa Monica, Calif. 90404

[21] Appl. No.: 09/227,442

[22] Filed: Jan. 8, 1999

[51] Int. Cl.[7] ..... F21V 21/108

[52] U.S. Cl. ..... 362/108; 362/189; 362/190; 362/205; 362/253; 446/219

[58] Field of Search ..... 362/3, 188, 189, 362/190, 191, 202, 205, 208, 253; 446/219

[56] References Cited

U.S. PATENT DOCUMENTS

| | | | |
|---|---|---|---|
| 4,740,874 | 4/1988 | Wylie et al. | 362/268 |
| 4,964,600 | 10/1990 | Lee | 248/146 |

*Primary Examiner*—Sandra O'Shea
*Assistant Examiner*—John Anthony Ward

[57] ABSTRACT

A new and improved flashlight including a cylindrical interior container having a cylindrical side wall of a first diameter terminating in a circular interior face and an open exterior face forming a chamber therein and a battery positioned within the chamber. The flashlight also includes a closure for the interior container with a central aperture for receiving a light bulb and with a parabolic reflector surrounding the light bulb and a transparent covering thereover. Also included as a component of the flashlight is an exterior container surrounding the primary container and a portion of the closure. The exterior container is flexible and of a size greater than that of the interior container. Lastly included is a quantity of particles located in the space between the interior container and the exterior container adapted to allow the exterior container.

4 Claims, 3 Drawing Sheets

BEAN BAG FLASHLIGHT

BACKGROUND OF THE INVENTION

1. Field of the Invention

The present invention relates to a bean bag flashlight and more particularly pertains to facilitating the reading of a held document by placing a flashlight on the shoulder of a reader.

2. Description of the Prior Art

The use of flashlights of known designs and configurations is known in the prior art. More specifically, flashlights of known designs and configurations heretofore devised and utilized for the purpose of facilitate illuminating objects and reading through known methods and apparatuses are known to consist basically of familiar, expected, and obvious structural configurations, notwithstanding the myriad of designs encompassed by the crowded prior art which has been developed for the fulfillment of countless objectives and requirements.

By way of example, a plurality of United States patents disclose flashlights and bean bags but nothing in the prior art discloses a bean bag flashlight as disclosed and claimed herein.

In this respect, the bean bag flashlight according to the present invention substantially departs from the conventional concepts and designs of the prior art, and in doing so provides an apparatus primarily developed for the purpose of facilitating the reading of a held document by placing a flashlight on the shoulder of a reader.

Therefore, it can be appreciated that there exists a continuing need for a new and improved bean bag flashlight which can be used for facilitating the reading of a held document by placing a flashlight on the shoulder of a reader. In this regard, the present invention substantially fulfills this need.

SUMMARY OF THE INVENTION

In view of the foregoing disadvantages inherent in the known types of flashlights of known designs and configurations now present in the prior art, the present invention provides an improved bean bag flashlight. As such, the general purpose of the present invention, which will be described subsequently in greater detail, is to provide a new and improved bean bag flashlight and method which has all the advantages of the prior art and none of the disadvantages.

To attain this, the present invention essentially comprises a new and improved bean bag flashlight facilitating the reading of a held document by placing a flashlight on the shoulder of a reader comprising, in combination a cylindrical interior container having a cylindrical side wall of a first diameter terminating in a circular interior face and an open exterior face forming a chamber therein and a battery positioned within the chamber. Also included is a threaded closure for the interior container with a central aperture for receiving a light bulb and with a parabolic reflector surrounding the light bulb and a transparent covering thereover. An exterior container surrounds the primary container and a threaded portion of the closure. The exterior container is flexible and of a size greater than that of the interior container. Lastly included is a quantity of beans exterior-like particle located in the space between the interior container and the exterior container adapted to allow the exterior container to conform to the shoulder of a user when placed thereon during activation of the light bulb and illumination of a document to be read.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bean bag flashlight which has all of the advantages of the prior art flashlights of known designs and configurations and none of the disadvantages.

It is yet another object of the invention to provide a new and improved bean bag flashlight which may be easily and efficiently manufactured and marketed.

It is further object of the present invention to provide a new and improved bean bag flashlight which is of durable and reliable constructions.

An even further object of the present invention is to provide a new and improved bean bag flashlight which is susceptible of a low cost of manufacture with regard to both materials and labor, and which accordingly is then susceptible of low prices of sale to the consuming public, thereby making such bean bag flashlight economically available to the buying public.

Even still another object of the present invention is to provide a bean bag flashlight for facilitating the reading of a held document by placing a flashlight on the shoulder of a reader.

Lastly, it is an object of the present invention to provide a new and improved flashlight including a cylindrical interior container having a cylindrical side wall of a first diameter terminating in a circular interior face and an open exterior face forming a chamber therein and a battery positioned within the chamber. The flashlight also includes a closure for the interior container with a central aperture for receiving a light bulb and with a parabolic reflector surrounding the light bulb and a transparent covering thereover. Also included as a component of the flashlight is an exterior container surrounding the primary container and a portion of the closure. The exterior container is flexible and of a size greater than that of the interior container. Lastly included is a quantity of particles located in the space between the interior container and the exterior container adapted to allow the exterior container to conform to any surface on which it is placed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
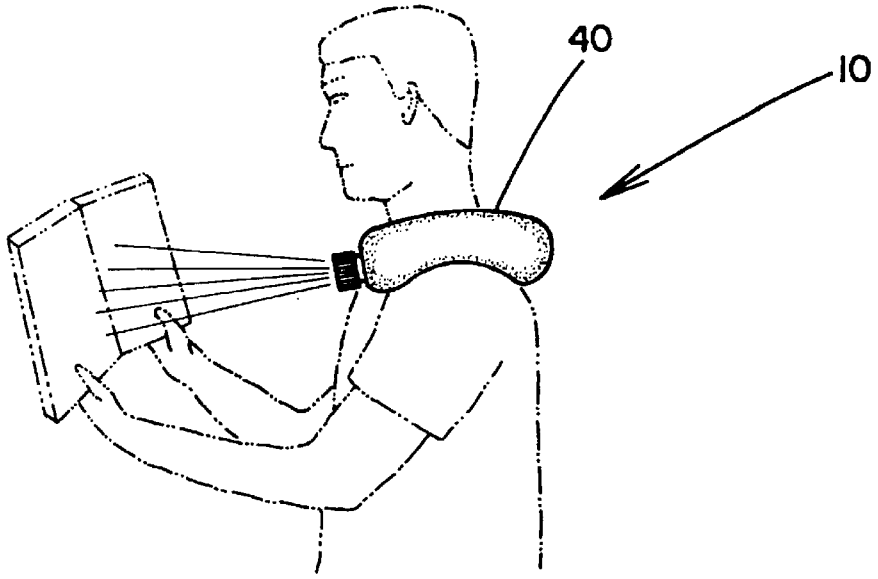
FIG. 1 is a perspective view of the preferred embodiment of the bean bag flashlight constructed in accordance with the principles of the present invention.
Figure 2:
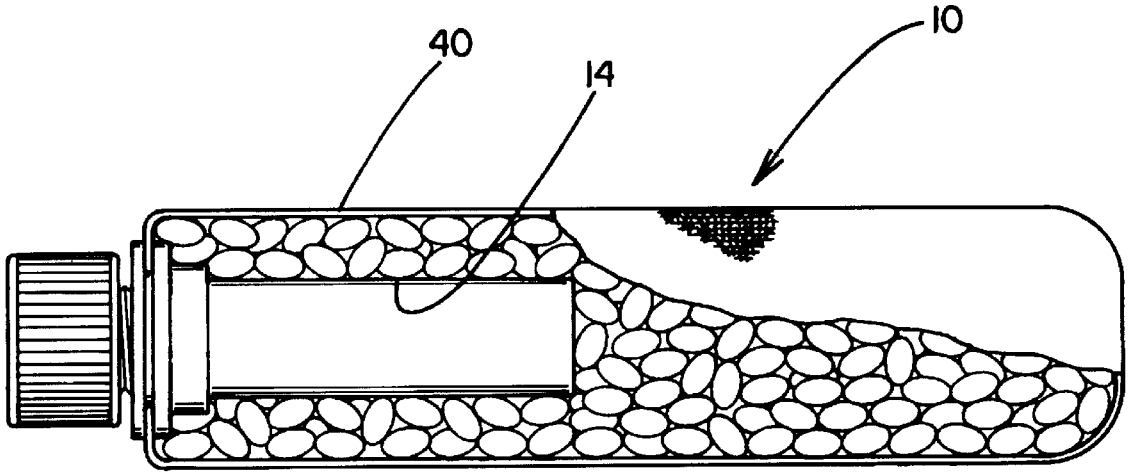
FIG. 2 is a cross-sectional view taken axially along the device shown in FIG. 1.
Figure 4:
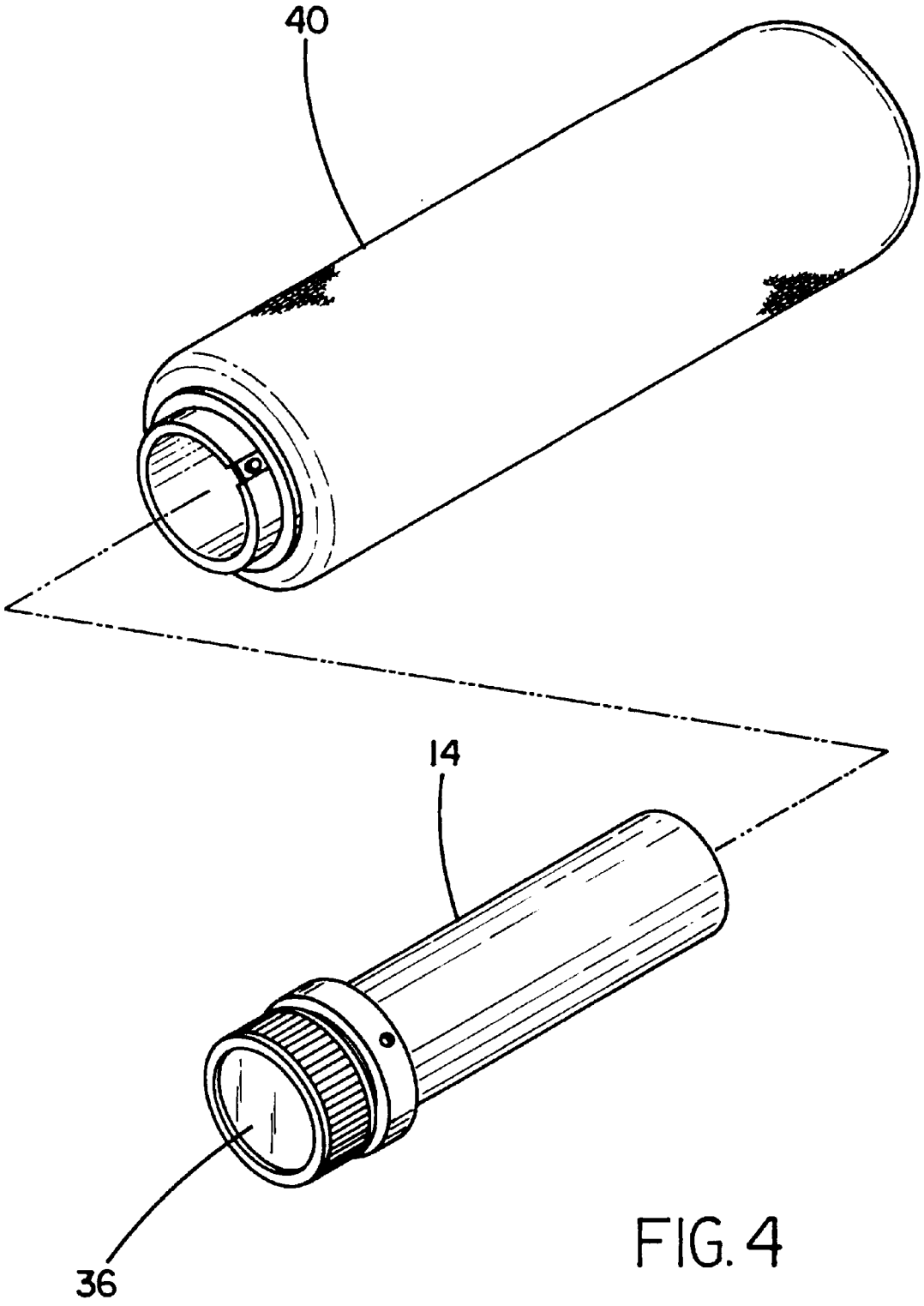
FIG. 4 is an exploded perspective view of the device shown in FIGS. 1–3.
Figure 3:
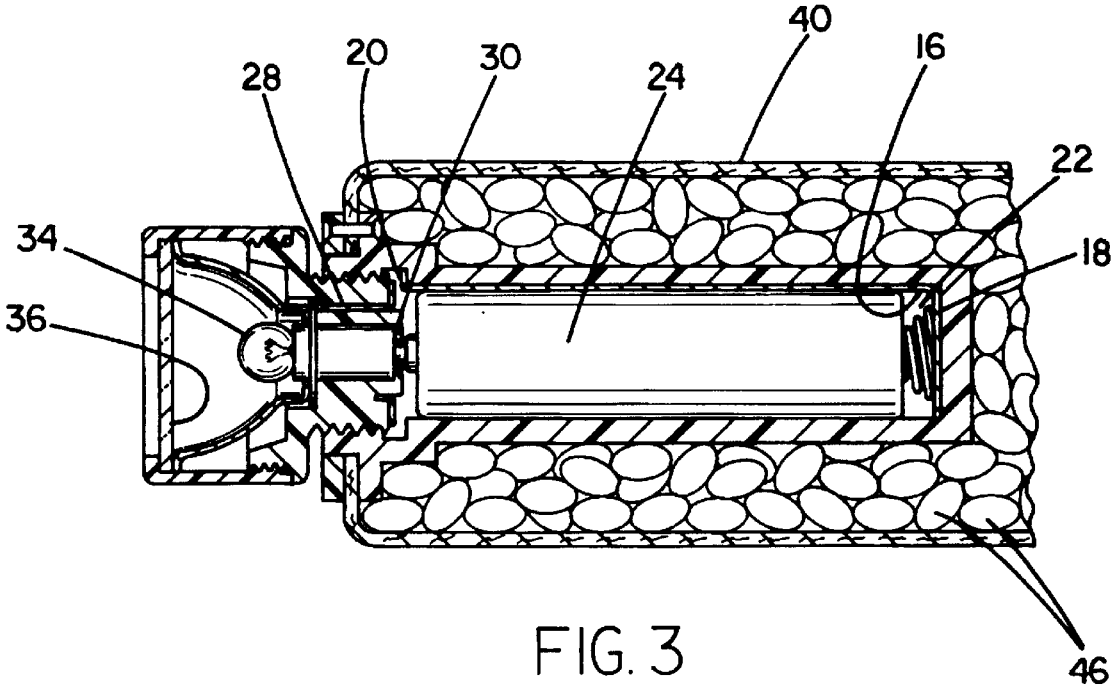
FIG. 3 is an enlarged cross-sectional view of the forward portion of the device shown in FIG. 2.

With reference now to the drawings, and in particular to FIG. 1 thereof, the preferred embodiment of the new and improved bean bag flashlight embodying the principles and concepts of the present invention and generally designated by the reference numeral 10 will be described.

The present invention, the bean bag flashlight 10 is comprised of a plurality of components. Such components are individually configured and correlated with respect to each other so as to attain the desired objective.

As described herein, the new and improved bean bag flashlight system 10 is for facilitating the reading of a held document. This is achieved by placing the flashlight on the shoulder of a reader. The system comprises, in combination a cylindrical interior container 14 having a cylindrical side wall 16 of a first diameter. Such container terminates in a circular interior face 18 and an open exterior face 20 which forms a chamber 22 therein. A battery 24 is positioned within the chamber.

Also included in the system is a threaded closure 28 for the interior container. The closure has a central aperture 30 for receiving a light bulb. A parabolic reflector 32 surrounds the light bulb 34 and a transparent covering 36 is located thereover.

Further included is an exterior container 40. Such container surrounds the primary container and a threaded portion of the closure. The exterior container is flexible and of a size greater than that of the interior container.

Lastly included is a quantity of beans-like particles 46 located in the space between the interior container and the exterior container. Such particles are adapted to allow the exterior container to conform to the shoulder of a user when placed thereon during activation of the lightbulb and illumination of a document to be read. The particles fill more than fifty percent of the rear extent of the exterior container while the interior container is in the forward extent of the exterior container.

Figure 5:
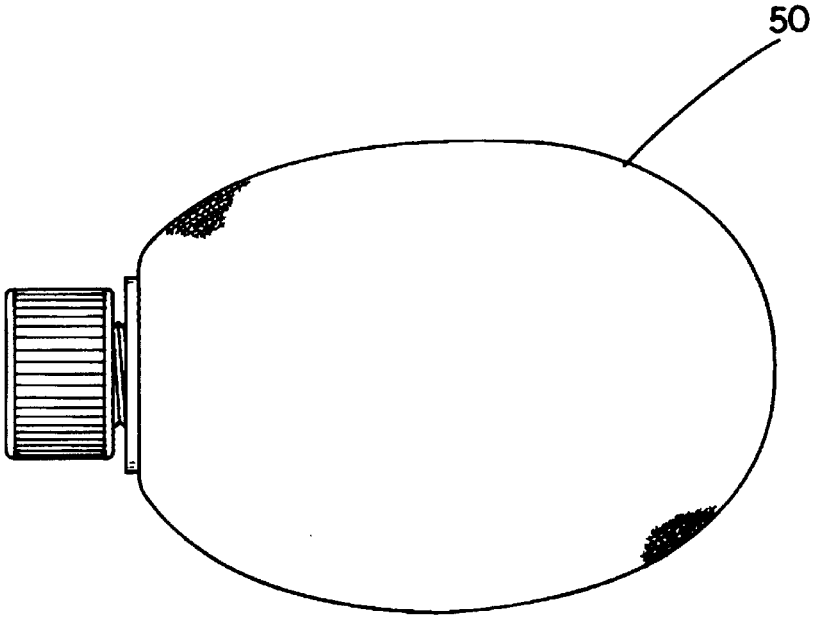
FIG. 5 is a perspective view of an alternate embodiment of the invention.

In the primary embodiment, shown in FIGS. 1–4, the exterior container is of a generally cylindrical configuration as described above. In the embodiment of FIG. 5, the alternate embodiment, the exterior container 50 is generally oval in configuration. The exterior container may take any of a plurality of shapes for fulfilling its intended purpose.

As described hereinabove, the bean bag flashlight of the present invention is a flashlight which is contained inside of a bean bag so that it can be aimed in any direction. The bag is made of a cloth material and shaped like an elongated tube. The tube allows the bean bag to be easily draped over the user's shoulder for reading in bed, or over other objects.

The flashlight is attached to the bean bag via two circular collars; an inner collar, which is shaped like a washer, and an outer collar which is integral the battery housing. The two collars may be fastened to each other and to the bag with glue, screws, rivets, etc., or the inner collar may be made with an internal thread, and the battery housing may be made with an external thread, so that the two pieces may be screwed together. The two collar designs described hereinabove also makes the bean bag light easy to assemble, because the bean bag may then be pushed through the inner collar attached to the bag. The bean bag may then be pushed through the inner collar, leaving the inner collar inside the bag. The bag may then be filled with bans (or other granular weights) and finally, the plastic battery housing may be inserted into the bag and attached to the inner collar.

The bulb and reflector assembly acts as the on/off switch for the flashlight, as well as the access door for changing the batteries.

In an alternate version of the bean bag flashlight the bean bag may be formed in a spherical shape so that the light beam can be aimed easily in any direction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bean bag flashlight facilitating the reading of a held document by placing a flashlight on the shoulder of a reader comprising, in combination:

a cylindrical interior container having a cylindrical side wall of a first diameter terminating in a circular interior face and an open exterior face forming a chamber therein and a battery positioned within the chamber;

a threaded closure for the interior container with a central aperture receiving a lightbulb and with a parabolic reflector surrounding the lightbulb and a transparent covering thereover;

an exterior container surrounding the primary container and a threaded portion of the closure, the exterior container being flexible and of a size greater than that of the interior container; and a quantity of beans exterior-like particle located in the space between the interior container and the exterior container adapted to allow the exterior container to conform to the shoulder of a user when placed thereon during activation of the lightbulb and illumination of a document to be read.

2. A new and improved flashlight comprising:

a cylindrical interior container having a cylindrical side wall of a first diameter terminating in a circular interior face and an open exterior face forming a chamber therein and a battery positioned within the chamber;

a closure for the interior container with a central aperture receiving a lightbulb and with a parabolic reflector surrounding the lightbulb and a transparent covering thereover;

an exterior container surrounding the primary container and a portion of the closure, the exterior container being flexible and of a size greater than that of the interior container; and a quantity of particles located in the space between the interior container and the exterior container adapted to allow the exterior container.

3. The apparatus as set forth in claim 2 wherein the exterior container is cylindrical in configuration.

4. The apparatus as set forth in claim 2 wherein the exterior container is oval in configuration.

* * * * *